US012571299B2

(12) United States Patent
Tokle et al.

(10) Patent No.: US 12,571,299 B2
(45) Date of Patent: Mar. 10, 2026

(54) ORIENTATION SYSTEM FOR DOWNHOLE DEVICE

(71) Applicant: DEVICO AS, Trondheim (NO)

(72) Inventors: Viktor Tokle, Trondheim (NO); Thomas Bjorgen, Trondheim (NO); Rune Lindhjem, Trondheim (NO); John Flaam, Trondheim (NO)

(73) Assignee: DEVICO AS, Trondheim (NO)

( * ) Notice: Subject to any disclaimer, the term of this patent is extended or adjusted under 35 U.S.C. 154(b) by 0 days.

(21) Appl. No.: 18/261,009

(22) PCT Filed: Jan. 11, 2022

(86) PCT No.: PCT/NO2022/050007
§ 371 (c)(1),
(2) Date: Jul. 11, 2023

(87) PCT Pub. No.: WO2022/154669
PCT Pub. Date: Jul. 21, 2022

(65) Prior Publication Data

US 2024/0060414 A1 Feb. 22, 2024

(30) Foreign Application Priority Data

Jan. 12, 2021 (NO) ..... 20210042

(51) Int. Cl.
*E21B 47/024* (2006.01)

(52) U.S. Cl.
CPC ..... *E21B 47/024* (2013.01)

(58) Field of Classification Search
CPC ..... E21B 47/024
See application file for complete search history.

(56) References Cited

U.S. PATENT DOCUMENTS 2,327,658 A * 8/1943 Miller ..... E21B 47/024 166/255.3
2,544,979 A 3/1951 Brokaw et al.
2004/0200083 A1* 10/2004 Yarbro ..... E21B 47/024 33/304

(Continued)

FOREIGN PATENT DOCUMENTS

WO 2016024867 A1 2/2016

OTHER PUBLICATIONS

Dictionary definition of "gyroscope", accessed Nov. 20, 2024 via thefreedictionary.com.*

(Continued)

*Primary Examiner* — Blake Michener
(74) *Attorney, Agent, or Firm* — Stites & Harbison, PLLC; Terry L. Wright

(57) ABSTRACT

Orientation system for downhole device (10), wherein the orientation system comprises an outer magnetic orientation lock assembly (460) arranged in connection with or integrated in the downhole device (10) and an orientation instrument assembly (400) for insertion into the outer magnetic orientation lock assembly (460), and wherein the orientation instrument assembly (400) comprises a sensor assembly (420) rotatably arranged in the orientation instrument assembly (400) and arranged for aligning or orienting in relation to the outer magnetic orientation lock assembly (460).

9 Claims, 5 Drawing Sheets

(56) References Cited

U.S. PATENT DOCUMENTS

Figure 1:
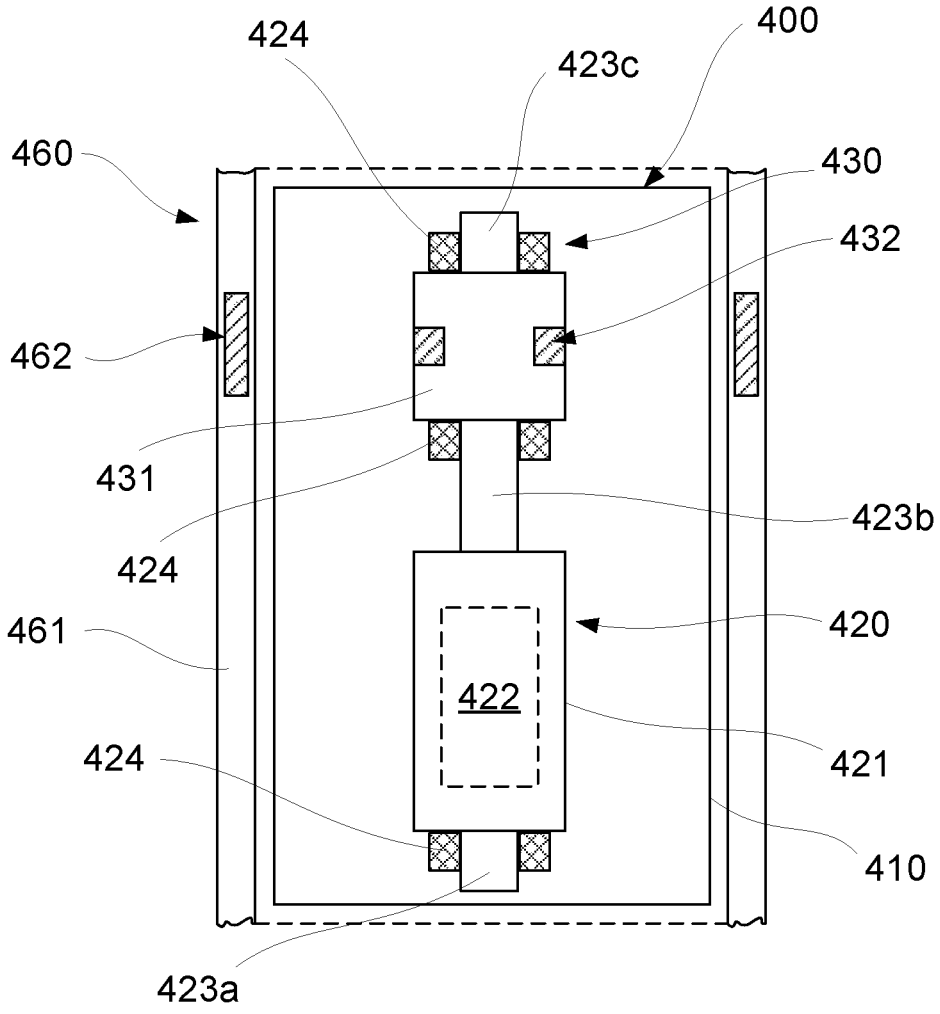

| | | | | |
|---|---|---|---|---|
| 2008/0294344 | A1* | 11/2008 | Sugiura | E21B 47/024 324/207.13 |
| 2009/0056938 | A1 | 3/2009 | Treviranus et al. | |
| 2013/0140087 | A1 | 6/2013 | Koch et al. | |
| 2017/0138174 | A1 | 5/2017 | Kuckes | |

OTHER PUBLICATIONS

Patent-OCH Registreringsverket, International Search Report and Written Opinion issued in corresponding Application No. PCT/NO2022/050007, mailed Mar. 2, 2022.

Patent-OCH Registreringsverket, International Preliminary Report on Patentability issued in corresponding Application No. PCT/NO2022/050007, mailed May 5, 2023.

* cited by examiner

ORIENTATION SYSTEM FOR DOWNHOLE DEVICE

The present invention is related to an orientation system for a downhole device, according to the preamble of claim 1.

The present invention is especially related to an orientation system for downhole devices like directional drills and downhole equipment or tools.

BACKGROUND

For orientation of downhole equipment, like directional drills, deflection devices (wedges/whipstocks), impression packer systems and similar, a Universal Bottom Hole Orientation (UBHO) system, or muleshoe, is often used. The muleshoe consists of two main parts, the pin mounted on the drill string or downhole device and the shoe mounted on the instrument assembly. As the instrument assembly is lowered into the drill string down to the downhole device the shoe engages with the pin and rotates the instrument assembly until the shoe and pin is in alignment. Such rotation requires force and is prone to fail, with the consequence of the orientation measurement also failing.

Further, for directional drilling, a drill consisting of an inner part and outer part is often utilized. The inner part connects the drilling string with the drill bit to transfer force and rotation from the drill rig. The outer part contains a system engaging the drill hole wall to prevent it from rotating with the inner part. The rotational orientation of the outer part decides the direction the directional drill will steer the drill hole.

The orientation of the outer part is typically controlled between drill runs. A common method to measure the orientation is to let the inner part lock mechanically with the outer part in a predetermined orientation. The orientation can then be measured by using an orientation instrument which sits within the inner part. When the inner and outer parts of the directional drill are locked relative to each other, the orientation of the orientation instrument determines the orientation of the outer part with the accompanying drill direction.

Such mechanisms for aligning and locking the inner part with the outer part can be complex to design and operate, typically requiring both physical rotation of the drill string and either spring loaded or water pressurized locking activation. It further often relies on the use of a muleshoe to mechanically orientate the orientation instrument within the directional drill. Accordingly, this method is cumbersome and further results in additional complexity in the drill design. Accordingly, it is a need for a non-mechanical solution, i.e. removing the need for the muleshoe and mechanical alignment of the inner and outer part of the directional drill.

From NO342903 B1 is known a system and a method for identifying or monitoring the orientation and position of a device, such as a tool, intended to be moved through or be stationary arranged a medium, such as rock. The system comprises an orientation unit including an outer element and an inner element, wherein a fixed reference point member is arranged on one element of the orientation unit. The system further comprises at least one first detector for at any time sensing and thus identifying the position of the fixed reference point member and at least one second detector for sensing earth gravity. A processor utilizes the data from the at least one first detector and at least one second detector for calculating and determining the rotational orientation of the fixed reference point member relative to earth gravity. The main disadvantage of this solution is that in practice the reference point member and the first detector will in many cases be a magnet and a magnetic field detector respectively. It will in that case be vulnerable to inaccuracies in the measurements due magnetic fields that is not from the fixed magnetic reference point in the outer tube, such as magnetization of the drill, earth magnet field and deflection of earth magnet field in the drill. This also requires that power source/battery would have to be nonmagnetic. The electronics of the system further suffer from being complex, something that also requires calibration.

Other examples of the use of magnets in the outer tube of a drill is known from e.g. U.S. Ser. No. 10/365,082 BB, US2012205154 AA (HALLIBURTON CO) and U.S. Pat. No. 2,544,979 A.

It is accordingly a need for an improved orientation system that removes the need for a traditional muleshoe.

It is further a need for an orientation system that is not affected by exterior magnetic fields.

Object

The main object of the present invention is to provide an orientation system for downhole device that partly or entirely solves the drawbacks of prior art.

An object of the present invention is to provide an orientation system for downhole device that removes the need for a traditional muleshoe during orientation measurements.

An object of the present invention is to provide an orientation system for downhole device that removes the need for mechanical alignment and locking of the inner and outer part of a downhole device.

It is an object of the present invention to provide an orientation system for downhole device where metering elements or sensors are not affected by external magnetic fields.

An object of the present invention is to provide an orientation system for downhole device capable of aligning with a fixed magnetic field direction in the downhole device.

It is an object of the present invention to provide an orientation system for downhole device capable of performing orientation measurements in all angles, also vertically.

An object of the present invention is to provide an orientation system for downhole device usable both for orientation of a directional drill and downhole equipment or tools.

Further objects of the present invention will appear from the following description, claims and attached drawings.

THE INVENTION

An orientation system for downhole device according to the present invention is defined by the technical features of claim 1. Preferable features of the orientation system according to the present invention is described in the dependent claims.

The present invention provides a novel orientation system, wherein the orientation system comprises an outer magnetic orientation lock assembly arranged in connection with or integrated in a downhole device and an inner orientation instrument assembly for insertion into the outer magnetic orientation lock assembly.

A downhole device is according the present invention a directional drill or a downhole equipment or tool.

The orientation system according to the present invention is thus suitable for orientation of directional drills as well as downhole equipment or tools.

According to the present invention, the orientation instrument assembly comprises a sensor assembly rotatably arranged in the orientation instrument assembly, which sensor assembly is arranged to a magnetic instrument alignment assembly. According to the present invention, the magnetic instrument alignment assembly is arranged for aligning or orienting the sensor assembly according to the magnetic field direction of the outer magnetic orientation lock assembly and locking the orientation of the sensor assembly in this position when the orientation instrument assembly is inserted into the outer magnetic orientation lock assembly for performing measurement of orientation of the downhole device.

According to one embodiment of the orientation system according to the present invention the sensor assembly comprises at least one metering element or sensor capable of measuring orientation direction.

According to one embodiment of the orientation system according to the present invention the outer magnetic orientation lock assembly comprises at least one magnet lock assembly.

In accordance with one embodiment of the orientation system according to the present invention, the outer magnetic orientation lock assembly comprises two magnet lock assemblies arranged diametrically in the outer magnetic orientation lock assembly.

According to one embodiment of the orientation system according to the present invention the magnetic instrument alignment assembly comprises at least one alignment magnet assembly.

In accordance with one embodiment of the orientation system according to the present invention the magnetic instrument alignment assembly comprises two alignment magnet assemblies arranged diametrically in the magnetic instrument alignment assembly.

According to one embodiment of the orientation system according to the present invention, the at least one magnet lock assembly or alignment magnet assembly comprises at least one magnet or a stack of magnets.

In accordance with one embodiment of the orientation system according to the present invention, the at least one magnet lock assembly is arranged with a magnetic field strength in transversal direction of the downhole device and the at least one alignment magnet assembly is arranged with a magnetic field strength in transversal direction of the orientation instrument assembly.

According to the present invention the magnetic field induced by the outer magnetic orientation lock assembly combined with the at least one alignment magnet assembly attached to the sensor assembly, will initiate a rotation of the sensor assembly within the orientation instrument assembly until the forces of the magnetic lock brings the sensor to an equilibrium and stops the rotation. The rotation therefore stops at a fixed orientation relative to the magnetic lock assembly and the downhole device.

When the rotational orientation is locked by the magnet lock, there is a one-to-one correspondence between the outer orientation of the downhole device and the internal sensor assembly.

By the present invention, it is possible to perform orientation measurements in all angles, also vertically. The possibility to perform orientation measurement in all angles is a considerable advantage over prior art solutions.

By the present invention it is provided an orientation system wherein at least one metering element or sensor of the sensor assembly of the orientation instrument assembly is oriented according to a fixed magnetic field direction provided by the outer magnetic orientation lock assembly fixed in connection with the downhole device and in addition locked in this position.

The present invention thus provides an orientation system removing the need for the traditional muleshoe and for physical orientation and locking of the orientation instrument assembly.

Preferable features and advantageous details of the present invention will appear from the following example description, claims and attached drawings.

EXAMPLE

Figure 2:
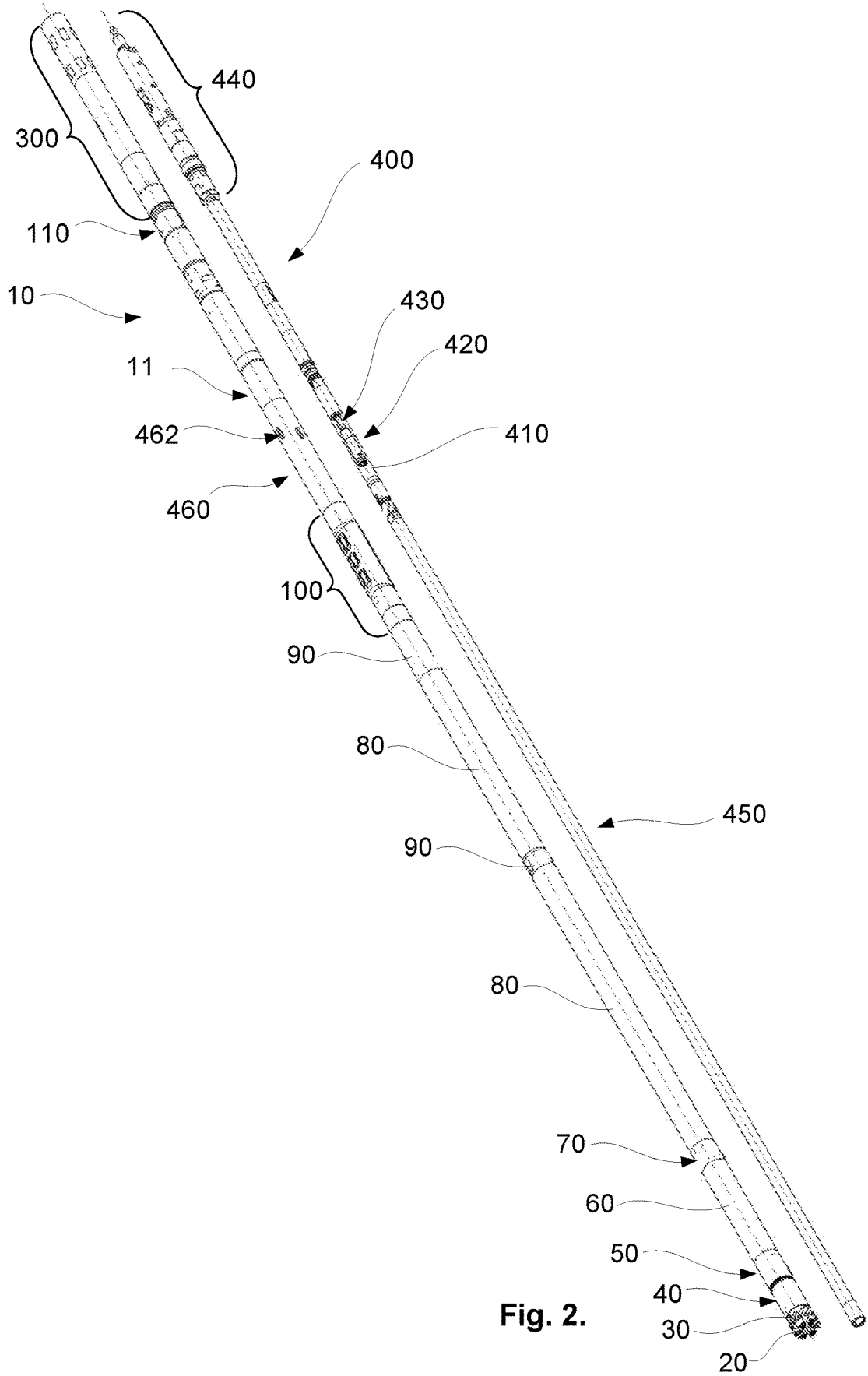
Figure 3:
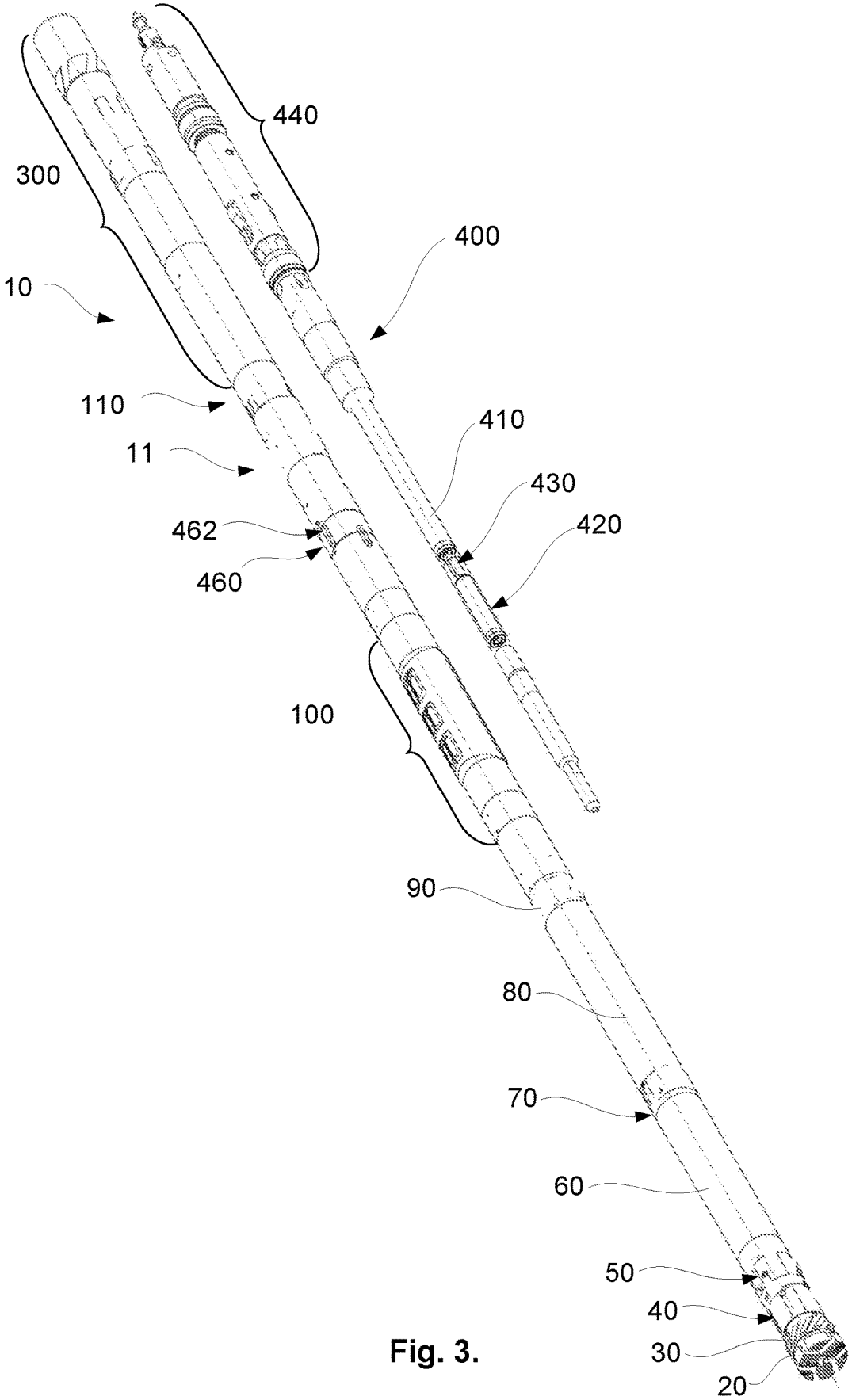
Figure 4:
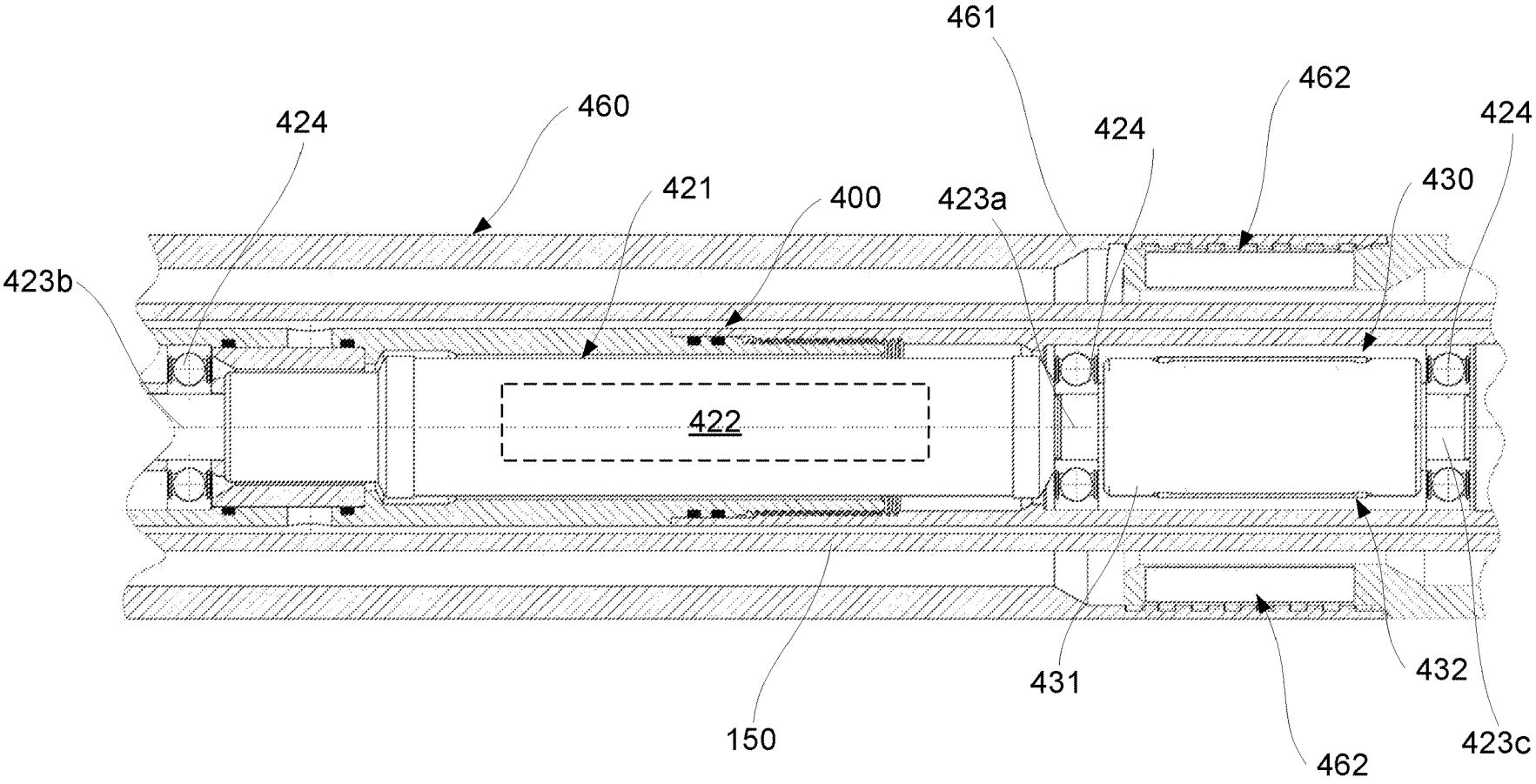
Figure 5:
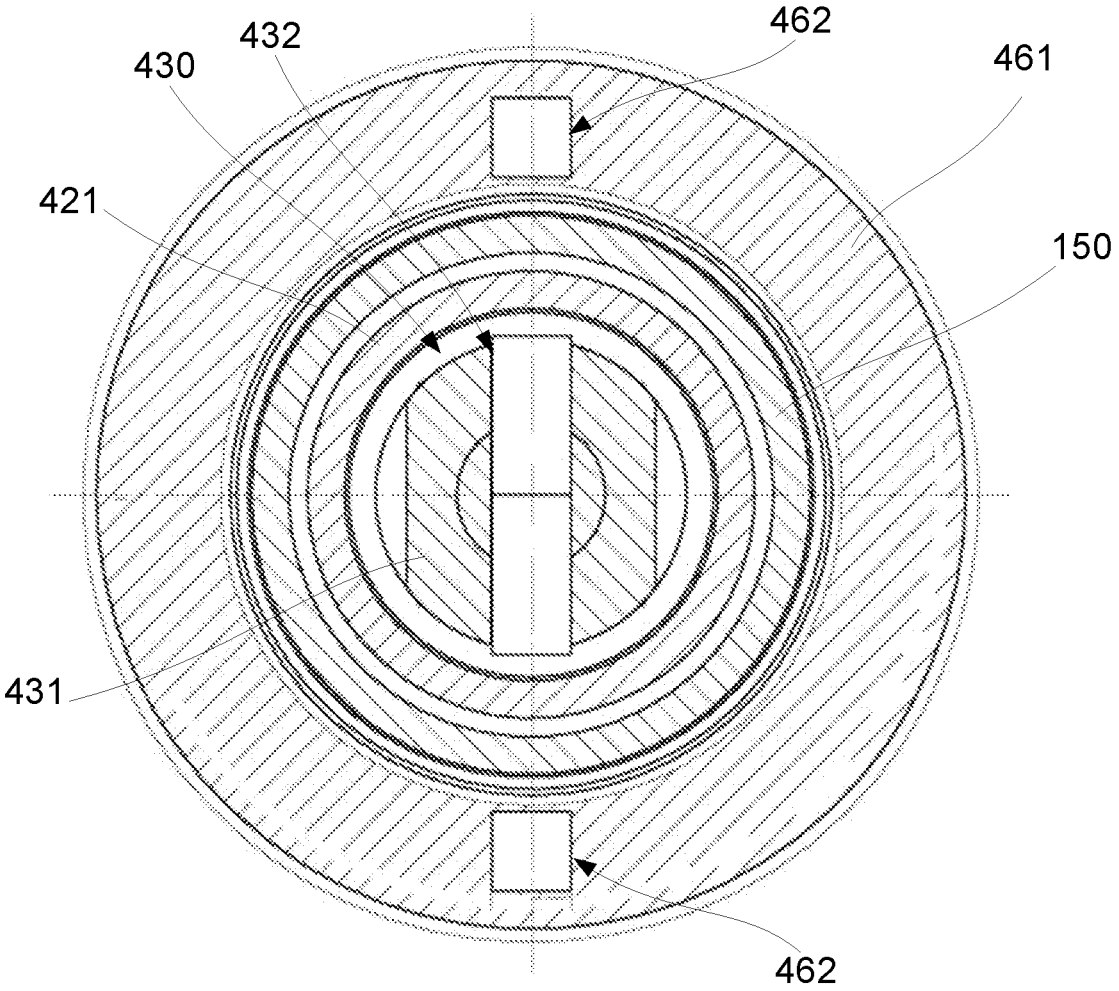

The present invention will below be described in further details with reference to the attached drawings, where:

FIG. 1 is a principle drawing of an orientation system according to the present invention, FIG. 2 are principle drawings of an orientation system according to the present invention adapted for use in a first embodiment of a downhole device according to the present invention, FIG. 3 are principle drawings of an orientation system according to the present invention adapted for use in a second embodiment of a downhole device according to the present invention, and FIG. 4-5 are cross-sectional views showing details of an orientation system according to the present invention.

Reference is now made to FIG. 1 showing a principle drawing of an orientation system according to the present invention. The orientation system according to the present invention comprises an outer magnetic lock orientation assembly 460 arranged in connection with or integrated in a downhole device 10 and an orientation instrument assembly 400 for insertion into the outer magnetic orientation lock assembly 460.

The orientation instrument assembly 400 according to the present invention will now be described with reference to FIG. 1 and FIGS. 4-5 showing further details of the orientation system according to the present invention.

The orientation instrument assembly 400 according to the shown embodiment of present invention comprise an exterior orientation instrument tube 410, which orientation instrument tube 410 is accommodating a sensor assembly 420 therein.

The sensor assembly 420 comprises an elongated sensor housing 421 accommodating a sensor platform 422 comprising at least one metering element or sensor capable of measuring orientation direction. The metering element or sensor is e.g. at least one accelerometer for detecting rotational angle in relation to the vertical plane. Alternatively or in addition, the at least one metering element or sensor is a magnetometer, gravity sensor or gyroscope such that the rotational angle of the orientation instrument assembly 400 can be determined at all inclinations.

The exterior orientation instrument tube 410 and elongated sensor housing 421 are of a nonmagnetic material, such as, e.g., but not limited to, titan or austenitic steel.

The elongated sensor housing 421 is further at both ends arranged to respective shafts 423*a-b* extending axially in opposite directions of the elongated sensor housing 421. The sensor assembly 420 is arranged rotatably in the exterior orientation instrument tube 410 by that the mentioned shafts 423*a-b* are arranged to respective radial bearing assemblies or spindle units 424 arranged in the exterior orientation instrument tube 410.

The sensor assembly 420 is thus freely rotatable and fixed in axial direction in the orientation instrument assembly 400, independent of remaining parts of the orientation instrument assembly 400.

According to the present invention, the orientation instrument assembly 400 further is provided with a magnetic instrument alignment assembly 430. The magnetic instrument alignment assembly 430 is in the shown embodiment formed by an elongated main body 431 accommodating at least one alignment magnet assembly 432.

The magnetic instrument alignment assembly 430 is in the shown embodiment arranged/fixed to one of the respective shafts 423*a-b* of the sensor assembly 420 at one side and arranged to a radial bearing assembly or spindle unit 424 arranged interior in the exterior orientation instrument tube 410 at the other side via shaft 423*c*. In this manner, the sensor assembly 420 and magnetic instrument alignment assembly 430 are axially aligned and will rotate as one unit in the exterior orientation instrument tube 410. The preferred embodiment contains a total of three radial bearing assemblies or spindle units 424, however any number from 1 and up may be used.

According to one embodiment of the present invention, the alignment magnet assembly 432 is formed by a stack of magnets arranged in transversal direction of the elongated main body 431.

According to another embodiment of the present invention the magnetic instrument alignment assembly 430 comprises two alignment magnet assemblies 432 arranged diametrically in transversal direction of the elongated main body 431, wherein each alignment magnet assembly 432 comprises at least one magnet or a stack of magnets. The alignment magnet assemblies 432 are arranged with their polarity in the same direction creating a stable magnetic field such that the sensor assembly 420 is provided with a definitive north side and south side. By using a stack of magnets, the two or more stacked magnets will have the same combined strength as one larger magnet.

The at least one magnet of the least one alignment magnet assembly 432 is arranged such that the magnetic field strength is in transversal direction of the orientation instrument assembly 400, and thus the outer magnetic orientation lock assembly 460 and the downhole device 10.

Non-limiting examples of magnets of the alignment magnet assembly 432, 462 are permanent magnets or Neodymium magnets of high strength.

In a further embodiment the magnets of the alignment assembly 432, 462 are controllable magnets, such as e.g. electropermanent magnets or electromagnets.

In yet a further embodiment the at least one magnet assembly 432 is formed by magnetic material capable of providing a stable magnetic field with a definitive north side and south side.

According to one embodiment of the present invention, the exterior orientation instrument tube 410 housing the sensor assembly 420, magnetic instrument alignment assembly 430 and radial bearing assembly or spindle unit(s) 424 is pressure proof. In an alternative embodiment of the present invention, the sensor housing 421 of the sensor assembly 420 is pressure proof and the radial bearing assembly or spindle unit(s) 424 and magnetic instrument alignment assembly 430 are designed to work in drill fluid. In yet a further embodiment both the exterior orientation instrument tube 410 and sensor housing 421 are pressure proof.

Reference is now made to FIGS. 2 and 3. At an upper end, the exterior orientation instrument tube 410 is provided with or arranged to a head assembly 440, such as a spear head for connection to a wireline with a retrieval tool (not shown).

The orientation instrument assembly 400 according to the present invention is thus adapted for reading the orientation of the downhole device 10 and allowing for re-orientation.

The outer magnetic orientation lock assembly 460 according to the present invention is arranged in connection with or integrated in the downhole device 10. The outer magnetic orientation lock assembly 460 may be integrated in the downhole device 10 by that that an existing part is designed to accommodate the outer magnetic orientation lock assembly 460 or that the magnetic lock orientation assembly 460 is adapted to be a part of the downhole device 10 by connection thereto. In the latter embodiment, the outer magnetic orientation lock assembly 460 is formed by an outer tube 461 that at ends thereof is provided with connections for arranging into or to the downhole device 10, at a desired position. The magnetic lock orientation assembly 460 may in principle be arranged at any desired position in the downhole device 10, as long as it is capable of interacting with the magnetic instrument alignment assembly 430 of the orientation instrument assembly 400.

In accordance with the present invention, the magnetic lock orientation assembly 460 comprises at least one magnet lock assembly 462. In the shown embodiment the at least one magnet lock assembly 462 is arranged in or integrated interior the outer tube 461 of the outer magnetic orientation lock assembly 460, but as mentioned above may also be integrated in an existing part of the downhole device 10.

According to the present invention, the magnet lock assembly 462 comprises at least one magnet or a stack of magnets arranged in transversal direction of the outer tube 461.

According to a further embodiment of the present invention, the outer magnetic orientation lock assembly 460 comprises two magnet assemblies 462 arranged diametrically opposite interior in the outer tube 461 or the downhole device 10.

According to the present invention the at least one magnet lock assembly 462 of the outer magnetic orientation lock assembly 460 is arranged such that it provides a reference of the downhole device high side.

Accordingly, the at least one magnet lock assembly 462 of the outer magnetic orientation lock assembly 460 provides a magnetic field inside the downhole device 10 and wherein the direction of the magnetic field provided by the at least one magnet lock assembly 462 is oriented/fixed in relation to the downhole device 10, or in a measurable relation to this.

The at least one magnet of the least one magnet lock assembly 462 is arranged such that a magnetic field strength is in transversal direction of the outer magnetic orientation lock assembly 460 and downhole device 10.

According to the present invention, the outer magnetic orientation lock assembly 460 and magnetic instrument alignment assembly 430 are designed such that when the orientation instrument assembly 400 is received in the outer magnetic orientation lock assembly 460, the magnetic instrument alignment assembly 430 is aligned with the outer magnetic orientation lock assembly 460.

When the orientation instrument assembly 400 is positioned in the outer magnetic orientation lock assembly 460, the at least one magnet assembly 462 of the outer magnetic orientation lock assembly 460 affects the at least one magnet assembly 432 of the magnetic instrument alignment assembly 430, such that the sensor assembly 420/sensor platform 422 of the orientation instrument assembly 400 aligns (is oriented) in a fixed direction determined by the magnetic field of the at least one magnet lock assembly 462 of the outer magnetic orientation lock assembly 460.

Due to the magnetic instrument alignment assembly 430 and sensor assembly 420 being rotatable in the orientation instrument assembly 400 and the magnetic lock function of the orientation system, the fixed orientation of the sensor assembly 420/sensor platform 422 will be maintained regardless of possible movements or rotations of the remaining parts of the orientation instrument assembly 400, as well as during e.g. drilling.

By the present invention is thus provided an orientation system with a magnetic alignment and lock function replacing the need for the use of a traditional muleshoe with mechanical alignment and locking of the inner and outer part of the downhole device 10, as the present invention works as a magnetic muleshoe.

The orientation system according to the present invention is suitable for downhole devices 10 like directional drills. The orientation system according to the present invention may also be used for orientation of other downhole equipment or tools, such as, but not limited to, wedges, mud motors, deflection devices/assemblies 70 and impression packer systems. In such a case, the outer magnetic orientation lock assembly 460 and outer tube 461 would typically be arranged above and in connection with the downhole device/assembly in question.

Some examples of the use of the orientation system according to the present invention used in a downhole device 10 in the form of a directional drill will now be described.

Reference is now made to FIG. 2 illustrating the orientation system according to the present invention adapted for use in a downhole device 10 in the form of a first embodiment of a directional drill according to the present invention, adapted for retrieving core samples, thus a core barrel drill.

The directional drill 10 comprises numerous parts in the longitudinal direction forming a directional barrel 11. The directional barrel 11 comprises, in order from below and up, a foremost drill bit 20 with a reamer 30, drive shaft connection assembly 40, a stabilizer assembly 50, a lower extension tube 60, a deflection assembly 70, one or more upper extension tubes 80, one or more stabilizer assemblies 90, rotation preventing assembly 100, a thrust bearing assembly 110 as well as an orientation and connector assembly 300 at upper end thereof.

The outer magnetic orientation lock assembly 460 of the orientation system according to the present invention is in this embodiment adapted for arrangement in the directional barrel 11. As a non-limiting illustrating example the outer magnetic orientation lock assembly 460 is arranged above the rotation preventing assembly 100 in the directional barrel 11.

The stabilizer assembly 50, lower extension tube 60, deflection assembly 70, stabilizer assembly 90, rotation preventing assembly 100, outer magnetic orientation lock assembly 460 are arranged for accommodating an inner drive shaft 150 (see FIG. 4) for driving the drill bit 20, wherein the drive shaft 150 is driven by a drill rig.

Further details of such a core barrel drill is well known for a skilled person and it is not necessary to discuss this in further detail herein.

The orientation instrument assembly 400 of the orientation system according to the present invention is in this embodiment adapted for insertion into the directional barrel 11 of the directional drill 10, as shown in FIG. 4 where the orientation instrument assembly 400 is inserted into the drive shaft 150 of the directional drill, and the mentioned outer magnetic orientation lock assembly 460.

FIG. 2 also shows an embodiment where the orientation instrument assembly 400 according to the present invention is provided with an optional core catcher assembly 450 of prior art at lower end.

Reference is now made to FIG. 3 illustrating the orientation system according to the present invention adapted for use in a downhole device 10 in the form of a second embodiment of a directional drill according to the present invention, provided with a full-face drill bit 20. The directional drill 10 comprises the same parts in the longitudinal direction 10 as the core barrel drill forming the directional barrel 11, but is not designed for retrieving core samples.

Also in this embodiment the outer magnetic orientation lock assembly 460 of the orientation system according to the present invention is adapted for arrangement in the directional barrel 11. As a non-limiting illustrating example, the outer magnetic orientation lock assembly 460 is arranged above the rotation preventing assembly 100 in the directional barrel 11.

Further details of such a directional drill is well known for a skilled person and it is not necessary to discuss this in further detail herein.

Accordingly, the at least one magnet of the least one alignment magnet assembly 432 is in this embodiment arranged such that the magnetic field strength is in transversal direction of the orientation instrument assembly 400, and thus the directional barrel 11 of the downhole device and the outer magnetic orientation lock assembly 460.

In the shown examples in FIGS. 2 and 3 the at least one magnet lock assembly 462 is orientated/fixed in relation to the drill bit 20 control direction, or in a measurable relation to this.

The at least one magnet of the least one magnet lock assembly 462 is arranged such that a magnetic field strength is in transversal direction of the downhole device 10 and the outer magnetic orientation lock assembly 460.

When the orientation instrument assembly 400 is received in the directional barrel 11 of the directional drill 10, the magnetic instrument alignment assembly 430 is aligned with outer magnetic orientation lock assembly 460.

When the orientation instrument assembly 400 is positioned in the directional barrel 11, the at least one magnet assembly 462 of the outer magnetic orientation lock assembly 460 in the directional barrel 11 affects the at least one magnet assembly 432 of the magnetic instrument alignment assembly 430, such that the sensor assembly 420/sensor platform 422 of the orientation instrument assembly 400 aligns (is oriented) in a fixed direction determined by the magnetic field of the at least one magnet lock assembly 462 of the outer magnetic orientation lock assembly 460, as well as magnetically locks the sensor assembly 420/sensor platform 422 in this position.

Usage Example

A usage example based on the shown directional drill 10 will now be described. In an initial step, the orientation instrument assembly 400 is pre-adjusted at the surface. The directional barrel 11 of the directional drill 10 is arranged in a jig, bench or similar and wherein the control direction of the drill bit 20 is positioned upwards, i.e. high side. The orientation instrument assembly 400 is next arranged in the directional barrel 11 and wherein the sensor assembly 420 due to the at least one alignment magnet assembly 432 automatically aligns against the at least one magnet lock assembly 462 of the outer magnetic orientation lock assembly 460 in the directional barrel 11. The orientation angle can be measured and sensor data read. The results will provide an angle depending on how the axis of the at least one metering element or sensor of the sensor assembly 420 is oriented in relation to the magnet field direction of the at least one magnet lock assembly 462.

A digital system can then be used to adjust the axis of the at least one metering element or sensor so that it is aligned with the magnetic field direction. In an alternative embodiment, the sensor assembly 420 is rotated in relation to the at least one alignment magnet assembly 432 of the magnetic instrument alignment assembly 430, such that the axis of the at least one metering element or sensor on the sensor assembly 420 is physically orientated towards the magnetic field direction. In yet another alternative embodiment, the magnetic instrument alignment assembly 430 and/or the at least one alignment magnet assembly 432 is rotated in relation to the sensor assembly 420.

When the adjustment is made, either digitally or physically, a control measurement of the orientation angle may be performed. The result should now e.g. be 0 degrees when the drill bit control direction is straight upwards, i.e. high side.

The directional drill 10 is now ready to be used for directional drilling or directional core drilling and may be lowered by the drilling string into the drill hole, with or without the orientation instrument assembly 400 installed, dependent on driller preference. Before drilling is started, the orientation instrument assembly 400 is lowered or pumped down the drilling string for accommodation in the directional drill 10. As the orientation instrument assembly 400 lands in the directional barrel 11 of the directional drill 10, the sensor assembly 420 is automatically/magnetically oriented/aligned (axially rotated) according to the magnetic field direction, as described above and magnetically locked in this position. The angle can now be measured by the at least one metering element or sensor on the sensor platform 422 of the sensor assembly 420 providing an angle relative to the orientation plane. If an accelerometer is used as the metering element or sensor the angle will be relative the vertical plane.

As the orientation instrument assembly 400 is locked in alignment with the directional barrel 11, the orientation angle, corresponding with the drilling direction, may further be logged continuously or periodically during the drilling operation. The orientation instrument assembly 400 may at any time be retrieved from the directional drill 10 with or without a core, respectively, for download and display of orientation data. A wireline may be utilized to retrieve the orientation instrument assembly 400 to surface. The orientation data may be utilized to control and adjust the drilling direction of the directional drill 10; hence the orientation system according to the present invention is suitable for both orienting and reorienting the directional drill. Before the drilling operation is continued, the orientation instrument assembly 400 is again inserted into the directional barrel 11.

By the present invention is accordingly provided an orientation system enabling the orientation of the downhole device to be measured independent of orientation angle of the inner/rotating part.

By the present invention is provided an orientation system that does not require a mechanical locking system and both use and design of the downhole device is simplified.

By the present invention is further provided an orientation system that does not require a muleshoe system.

The present invention may be combined with a separate locking system, for instance similar to the applicant's patent NO334083 where the sensor assembly 420 is locked from rotating under certain conditions, e.g. low or high drill fluid pressure. As the orientation instrument assembly 400 is retrieved from the downhole device 10, the magnetic lock is normally disengaged. A separate locking system may be used to hold the orientation fixed, allowing the recorded orientation data to be utilized also for core orientation measurements.

If using gyroscope sensors a drill hole can be directionally surveyed while the orientation instrument assembly 400 is retrieved from the drill hole.

Since the magnets will hold and stay stationary during drilling, the orientation instrument assembly 400 can be mounted with a cable for reading live orientation data as drilling progresses.

The invention claimed is:

1. Orientation system for downhole device, comprising
- an outer magnetic orientation lock assembly arranged in connection with or integrated in the downhole device, and
- a retrievable orientation instrument assembly for insertion into the outer magnetic orientation lock assembly,
- wherein the retrievable orientation instrument assembly comprises a sensor assembly and a magnetic instrument alignment assembly,
- wherein the sensor assembly comprises a sensor housing and at least one metering element or sensor housed therein,
- wherein the sensor assembly and magnetic instrument orientation assembly are rotatably arranged in the retrievable orientation instrument assembly,
- wherein the magnetic instrument alignment assembly is axially aligned with and spaced apart from the sensor assembly and fixed thereto so that they rotate as one unit, and
- wherein the magnetic instrument alignment assembly is aligning or orienting the sensor assembly according to the magnetic field direction of the outer magnetic orientation lock assembly and locking the position of the sensor assembly in this position for measuring the orientation of the downhole device.

2. Orientation system according to claim 1, wherein the outer magnetic orientation lock assembly comprises at least one magnet lock assembly.

3. Orientation system according to claim 2, wherein the outer magnetic orientation lock assembly comprises two magnet lock assemblies arranged diametrically in the outer magnetic orientation lock assembly.

4. Orientation system according to claim 2, wherein the magnetic instrument alignment assembly comprises at least one alignment magnet assembly, and wherein the at least one magnet lock assembly or the at least one alignment magnet assembly comprises at least one magnet or a stack of magnets.

5. Orientation system according to claim 2, wherein the at least one magnet lock assembly is arranged with a magnetic field strength in transversal direction of the downhole device and wherein the magnetic instrument alignment assembly comprises at least one alignment magnet assembly, the at least one alignment magnet assembly arranged with a magnetic field strength in transversal direction of the retrievable orientation instrument assembly.

6. Orientation system according to claim 1, wherein the magnetic instrument alignment assembly comprises at least one alignment magnet assembly.

7. Orientation system according to claim 6, wherein the magnetic instrument alignment assembly comprises two alignment magnet assemblies arranged diametrically in the magnetic instrument alignment assembly.

8. Orientation system according to claim 1, wherein the at least one metering element or sensor is one or more of: accelerometer, magnetometer, gravity sensor and/or gyroscope.

9. Orientation system according to claim 1, wherein the orientation system further comprises the downhole device, and wherein the downhole device is a directional drill.

* * * * *